US005326947A

United States Patent [19]

Edds et al.

[11] Patent Number: 5,326,947

[45] Date of Patent: Jul. 5, 1994

[54] ARC EXTINGUISHING DEVICE MADE OF CONDUCTIVE PLASTIC

[76] Inventors: Thomas A. Edds, 3512 Old Orchard Rd. NE.; Willard J. Rezac, 6817 Devonshire Dr. NE., both of Cedar Rapids, Iowa 52402

[21] Appl. No.: 976,077

[22] Filed: Nov. 13, 1992

[51] Int. Cl.[5] ..... H01H 33/08; H01H 9/34

[52] U.S. Cl. ..... 200/144 R; 200/144 C; 200/148 C

[58] Field of Search ..... 200/144, 147 B, 148, 200/150 R, 144 C, 144 R, 148 R, 148 C, 149 R, 150 H

[56] References Cited

U.S. PATENT DOCUMENTS 3,071,666 1/1963 Ellsworth et al. ..... 200/144
4,500,595 2/1985 Gerteisen et al. ..... 428/294
4,664,971 5/1987 Soens ..... 428/288
4,690,778 9/1987 Narumiya et al. ..... 252/506
5,004,561 4/1991 Nomura et al. ..... 252/511

*Primary Examiner*—Jeffrey A. Gaffin
*Assistant Examiner*—Michael A. Friedhafer
*Attorney, Agent, or Firm*—Larry I. Golden; Kareem M. Irfan

[57] ABSTRACT

The present invention provides a static dissipative composition as a method of removing electric potential from an arc extinguishing device in an electrical distribution device. The inventive composition includes a thermoplastic base resin and an effective amount of a conductive modifier to exhibit static dissipative properties and remove electric potential from the arc extinguishing device of an electrical distribution device. Arc extinguishing devices for use in circuit breakers and the like are made of these inventive compositions.

41 Claims, 2 Drawing Sheets

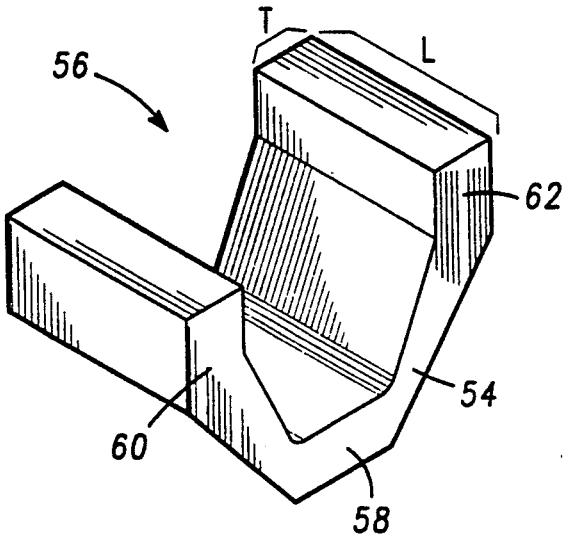
Fig. 2
50
Fig. 3
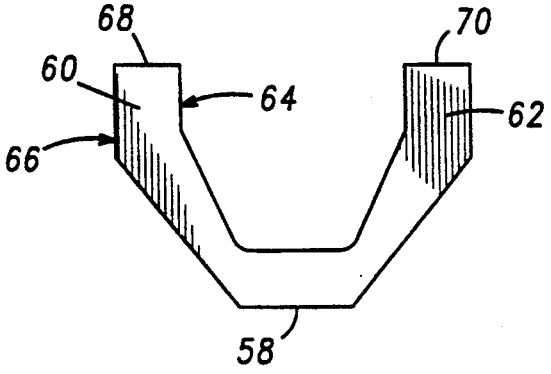

ARC EXTINGUISHING DEVICE MADE OF CONDUCTIVE PLASTIC

RELATED APPLICATION

Related co-pending U.S. application Ser. No. 07/976,076 filed on even date herewith, now abandoned, discloses one class of arc extinguishing devices which is suitable for use in the present application. The entire teaching and disclosure of that co-pending application is incorporated herein by reference.

1. Field of the Invention

The present invention relates to circuit breakers, circuit interrupters, electrical distribution devices and the like, and more particularly, to an arc extinguishing device made of an improved material for use therein.

2. Background of the Invention

Circuit breakers are commonly used to protect branch circuits in residential and commercial buildings against overload and fault conditions. Basically, a circuit breaker includes a separable pair of electrical contacts, a spring-operated mechanism for effecting separation of the contacts, and a tripping mechanism upon the occurrence of the overload or fault condition. A representative circuit breaker is fully set forth in U.S. Pat. No. 2,889,428, issued to Kingdon et al. and U.S. Ser. No. 722,050, issued Oct. 26, 1992, to Cook et al., both commonly assigned to the assignee herein and incorporated by reference.

An electric arc is produced each time the circuit breaker contacts are opened or closed. The detrimental effects from the arc on other internal components is most severe during interruption of the electrical contacts. An arc extinguishing mechanism is used to control and extinguish the arc and protect the other components of the circuit breaker.

For example, a common type of arc shield, which is placed in a recess or arc chamber of a circuit breaker is a series of spaced magnetic plates as illustrated in U.S. Pat. No. 2,811,607 issued to Dorfman et al. Another type of arc extinguishing mechanism is set forth in U.S. Pat. No. 2,898,427 issued to Nadeau, which discloses a one-piece u-shaped magnetic metallic member having a plurality of parallel slots with an arc runner portion to lead the arc to a venting passage. U.S. Pat. No. 2,429,722 to Jennings discloses an arc extinguisher using insulating side members mounted between the legs of u-shaped magnetic members and the side walls of the breaker casing. Another example is U.S. Pat. No. 4,616,200 issued to Fixemer et al. which discloses a molded arc barrier projecting into the arc chamber to shield the operating mechanism of the circuit breaker.

The need arises to distribute more power through enclosures which are the same size or smaller. This requires increasing the electrical rating of the circuit breaker to carry same voltage and current density while decreasing the size of the enclosure and the components therein like the arc extinguishing means.

Among the problems caused by increasing the electrical rating of a circuit breaker is the heat emitted by the arc created when interrupting the electrical contacts. Without dissipation of the arc and the heat build-up the other components of the circuit breaker will be damaged.

SUMMARY OF THE INVENTION

Accordingly, the present invention provides an arc extinguishing device for disposition along a pre-determined path of movement between two electrical contacts in an electrical distribution device. The device includes a generally U-shaped member having a bight portion is defined by a bottom wall with two upstanding side walls. The bight portion has sufficient width to allow the movement of the electrical contacts between the two side walls. The u-shaped member is made of a conductive plastic composition. The composition includes a thermoplastic base resin and an effective amount of a conductive modifier to exhibit static dissipative properties and remove electric potential from the u-shaped member.

The present invention also includes an electrical distribution device which includes a housing and a pair of electrical contacts positioned within the housing. At least one contact is moveable in and out of engagement with the other along a pre-determined path. The electrical distribution device also includes an arc extinguishing device as described above.

In accordance with the present invention there is provided a static dissipative composition for removing electric potential from an arc extinguishing device in an electrical distribution device. The composition includes a thermoplastic base resin and an effective amount of a conductive modifier to exhibit static dissipative properties and remove electric potential from the arc extinguishing device of an electrical distribution device.

The present invention also contemplates a method of removing electric potential from an arc extinguishing device utilized in an electrical distribution device. The method includes the step of molding an arc extinguishing device from a conductive plastic composition. The composition has a thermoplastic base resin and an effective amount of a conductive modifier to exhibit static dissipative properties.

It is an object of the present invention to provide an arc extinguishing device which overcomes the aforementioned problems affecting interruption of circuit breakers in small enclosures.

Another object of the present invention is to provide inventive compositions for a device to extinguish electric arcs of greater current in smaller spaces than the prior art.

A further object of the invention is to provide an improved arc extinguishing device which protects the other components of a circuit breaker from exposure to an electric arc at high fault levels.

Yet another object of the present invention is to provide inventive compositions for an arc extinguishing device which allows flexibility of design with ease of assembly and economical manufacture.

Other and further advantages, embodiments, variations and the like will be apparent to those skilled in the art from the present specification taken with the accompanying drawings and appended claims.

BRIEF DESCRIPTION OF THE DRAWINGS

In the drawings, which comprise a portion of this disclosure;

FIG. 2 is an enlarged, isolated perspective view of the embodiment of the arc extinguishing device illustrated in FIG. 1; and FIG. 3 is a cross-sectional view of the arc extinguishing device embodiment along the lines 3—3 in FIG. 2.

DETAILED DESCRIPTION

Figure 1:
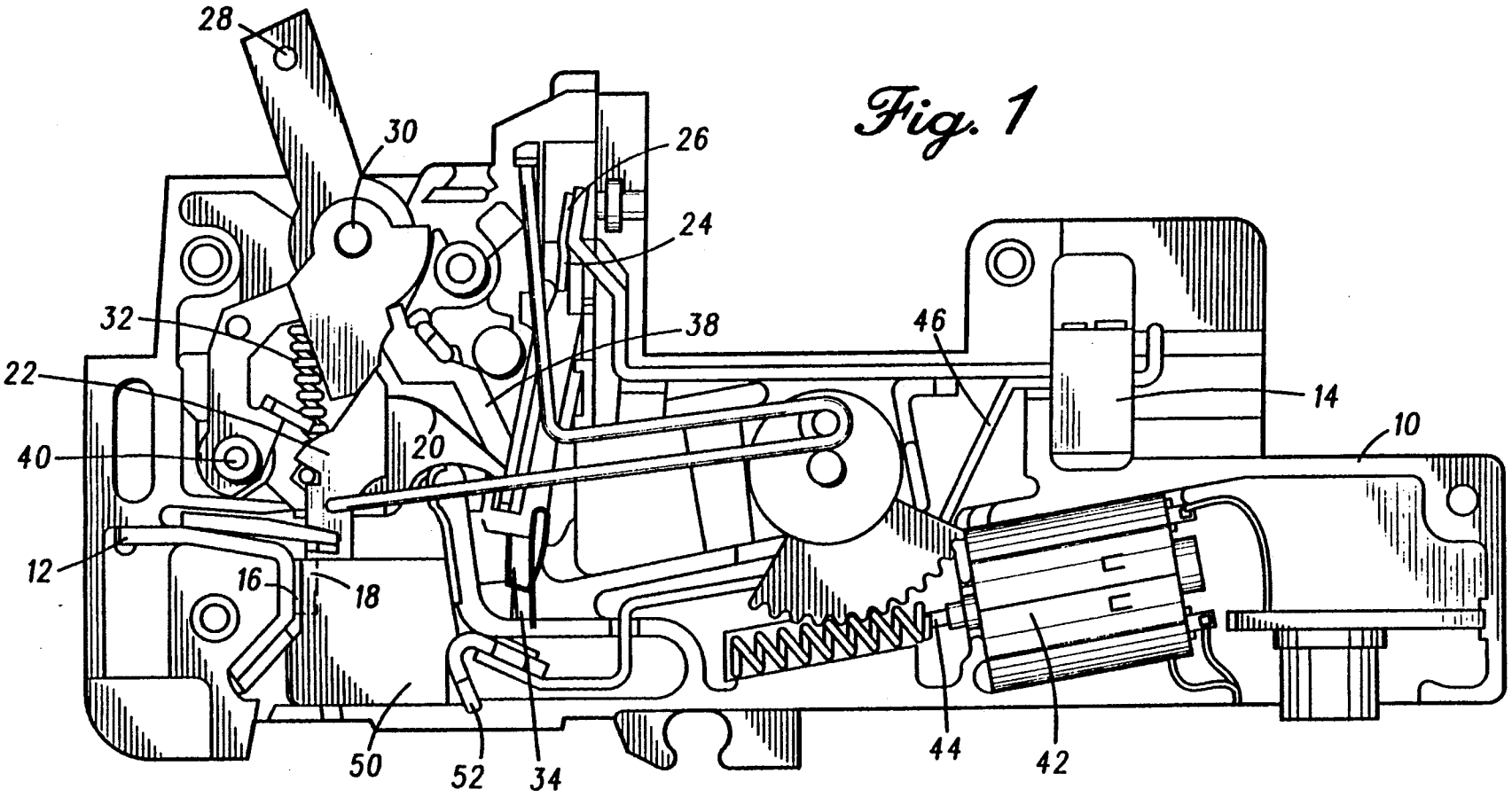
FIG. 1 is a side view of a circuit breaker according to the present invention wherein the side cover is removed showing the position of an embodiment of the inventive arc extinguishing device.

Turning now to the drawings and referring specifically to FIG. 1, an example of an embodiment of the present embodiment is illustrated in the form of a remotely controlled circuit arrangement. The arrangement includes an insulating body or housing 10 open at one face with a detachable cover (not shown). A line terminal 12 and a load terminal 14 completes the circuit between a source and a load (not shown).

The circuit path beginning at the line terminal 12 carries current through stationary and movable contacts 16 and 18. The circuit continues through a flexible copper conductor 20 which is connected between a carrier 22 and a bimetal member 24. The movable contact 18 may be formed as part of the carrier 22. A rigid conductive plate 26 is welded to the bimetal member 24 to carry current from the bimetal member 24 to the load terminal 14.

The above-described current path is controlled remotely and locally by a number of different components. Some of the components are similar in structure and operation to the corresponding components in Square D Company Model Nos. QO-PL and QOE, and in U.S. Pat. No. 4,623,859 and U.S. Ser. No. 722,050 issued Oct. 26, 1992, both entitled "Remote Control Circuit Breaker," assigned to the instant assignee and incorporated herein by reference.

Local control of the circuit breaker arrangement is provided using the external operating handle 28 pivotally mounted about an axis 30 in the housing 10 to control the contact carrier 22. In response to the movement of the handle 28 to the right or left, the carrier 22 is moved counterclockwise or clockwise, respectively, by the action a biasing spring 32. The handle 28 moves the top of the carrier 22 to either side of the equilibrium position, so that the bottom of the carrier 22 biases the movable contact 18 to either the open or closed position.

The trip mechanism assembly includes an armature 34, the bimetal member 24 and a yoke 36. Upon occurrence of a moderately sustained overload, from the contact-closed position the bimetal member 24 heats up and flexes to the right, causing the armature 34 and the yoke 36 to swing counterclockwise releasing the standoff pressure of the end of the trip lever 38. The trip lever 38 swings clockwise about pin 40 and pulls the carrier 22 away from the stationary contact 16 to interrupt the current path.

Similarly, upon occurrence of an extensive current overload, the yoke 36 manifests a magnetic force that attracts and swings the armature 34 counterclockwise. The trip lever 38 then swings clockwise and the spring 32 pulls the carrier 22 interrupting the current path.

Remote control of the circuit breaker arrangement is provided using a motor 42 having a shaft 44 which rotates in one direction to pull the carrier 22 and interrupt the current path. Rotation of the shaft 44 in the opposite direction allows the carrier to be pulled by spring 32 to re-establish the current path.

During a short-circuit condition or interruption of the current path, energy is shunted around the bimetal member 24. A shunt terminal 46 extends from the load terminal 16 to an arc extinguishing device 50 to dissipate the arcing current. An arc yoke 52 attracts the arc and shunts the current around the bimetal member 24.

The arc extinguishing device is illustrated in isolation in FIGS. 2 and 3. The arc device 50 includes a generally u-shaped member 54 having a bight portion 56 defined by bottom wall 58 with two upstanding side walls 60 and 62. The side walls 60 and 62 have an inside face 64 and an outside face 66 which terminate at the top edges 68 and 70, respectively.

Both side walls 60 and 62 have a thickness T and a length L as shown in FIG. 2. In the preferred embodiment, the thickness T of each side wall 60, 62 and substantially the entire arc device 50 is in the range of about 0.0625 to about 0.125 inches and preferably measuring about 0.10 inches. The length L of the arc device 50 as measured along the top edges 68 and 70 is in the range of about 0.25 to about 0.50 inches and preferably measuring about 0.29 inches. The length L is sufficiently long to encompass a substantial portion of the path of movement of the contact 18. The width of the bight 56 or the distance between the side walls 60 and 62 is sufficient to allow the contacts to pass between them.

The measurements of the arc device 50 are adjusted to accommodate the capacity of the circuit breaker. For the measurements discussed above, the capacity of the circuit breaker ranges from about 15 to about 30 amps.

Although it is preferable that a one-piece arc device 50 having a generally u-shaped configuration is used, any configuration which substantially encloses three sides of the path of movement of the electrical contacts like 18 is contemplated by the present invention. The configuration can be slanted or otherwise shaped to accommodate existing housings and other components in a circuit breaker.

Multiple arc devices having the same or different lengths and positioned in series with end to end are also contemplated. An air gap can be inserted between the ends of adjacent multiple arc devices.

Preferably, the electric potential accumulated on the arc device 50 during the interruption of the electrical contacts 16, 18 is drained through a connector (not shown) and subsequently through a resistor to a neutral or ground. A suitable resistance value for the resistor is about 0.15 milliohms for a 30 amp circuit breaker. Other means for grounding the arc device 50 are suitable for use in the present invention.

Although a circuit breaker is illustrated, the present invention is suitable for protecting all types of electrical distribution devices such as circuit interrupters and the like. In practical applications, it is still desirable to have all electrostatic sensitive components insulated from direct contact with any part of the arc device 50.

The arc device 50 is made of a conductive plastic composite which has certain electrical properties. The U.S. Department of Defense Handbook 263 describes three categories of plastic composites for use in electrostatic discharge protection. They are anti-static, static dissipative, and conductive. Although the resistivity characteristics of these three categories is not entirely settled, static dissipative composites are usually defined to have surface resistivities of greater than $10^5$ and less than $10^9$ ohms per square. Since static dissipative composites are more conductive then anti-static composites, they dissipate electric potential more quickly. Also, because of their make-up, they more readily conduct the potential throughout the volume of the part. Thus, static dissipative composites allow more rapid bleed-off of electric potential. The ASTM Standard D-257 provides uniform procedures for determining the resistance of a material. These methods are used to determine both surface and volume resistivities of the composite.

The inventive composites do not change their static dissipative electrical resistivity properties over time because they are formed by compounding or mechanically blending a solid conductive modifier with a thermoplastic base region. The homogeneity and level of dispersion of one or more conductive modifiers within the thermoplastic base resin are the important criteria affecting the performance of the composites. The resulting composites are permanent in their static dissipative properties with a surface resistivity less than $10^9$ ohms per square and a volume resistivity preferably less than 10 ohms per centimeter.

Other components to the inventive composites are limited to those conventional additive like inhibitors, etc., needed for the composites to exhibit the requisite manufacturing or mechanical properties discussed below. These additives are present in small amounts relative to the thermoplastic base resin and the conductive modifier.

The conductive modifiers include electrically conductive powders and fibers. Preferred modifiers include carbon black powder, carbon graphite fiber, stainless steel fiber and powder, and nickel coated graphite fiber. Other types of metallic coatings are suitable for use on graphite fibers.

The concentration of the conductive modifier is effective to have the composite exhibit static dissipative electrical resistivity properties and remove electric potential therefrom. A suitable weight percent concentration of the conductive modifier in the thermoplastic base resin is in the range of about 4 to about 20 percent. A more preferred range is about 5 to about 15 percent by weight. The metallic containing conductive modifiers like stainless steel and nickel coated graphite have concentrations in the lower area of this range, for example, about 5 to about 10 percent by weight. Since amorphous carbon black has a lower aspect ratio than graphite carbon, it needs concentrations in the higher end of the range to impart the desired electrical properties, like about 15 to about 20 percent by weight. The graphite fiber is preferred in the middle of the range, for example, about 10 to about 15 percent by weight. Preferably, the weight concentration of stainless steel fiber in nylon 6 is about 10 percent.

Composites containing carbon black powder as the conductive modifier are presently the most cost effective. However, a high percent loading is required and this can result in a composite with lessened mechanical properties in comparison to the unmodified base resin. If higher properties are needed, such as impact strength or stiffness, then another conductive modifier such as carbon fiber, is used to gain optimal properties.

The present invention also provides for using a magnetic material as the conductive modifier in a concentration effective to have the composite exhibit magnetic properties which increase the mobility and further dissipate the arc current. A preferred magnetic material as the conductive additive is stainless steel fiber or nickel coated steel fiber. A suitable weight percent concentration of the conductive modifier in the thermoplastic resin is in the range of about 60 to about 80 percent. Depending on the magnetic material selected as the conductive modifier, a weight percent less than this range improves the performance of the arc device because the composite is conductive. However, the composite does not exhibit significant magnetic properties and the associated advantages.

The following thermoplastic base resins are suitable for use with the present invention in compounding composites with most types of conductive modifiers: polypropylene, nylon 6/6, nylon 6, nylon 11, nylon 6/12, high-impact nylon, mineral-filled nylon, polycarbonate, polystyrene, acrylonitrile butadiene styrene, high density polyethylene, low density polyethylene, polysulfone, polybutylene terphthalate, polyethylene terphthalate, polyphenylene sulfide, polyester thermoplastic elastomer, polyetherimide, styrenic thermoplastic elastomer, and olefinic thermoplastic elastomer.

The following base resins are more compatible for compounding with carbon fiber, nickel coated graphite fiber and stainless steel as the conductive modifier: acetal, polyurethane thermoplastic, polyphenylene oxide, polyetheretherketone, phenylene ether co-polymer, polycarbonate/acrylonitrile butadiene styrene, polyarylether ketone, polyetherketoneetherketoneketone, polyphthalamide, and polyetherketoneketone. Other suitable base resins include perfluoroalkoxy, ethylene tetrafluoroethylene, and polyvinylidene fluoride.

The preferred thermoplastic base resins include nylon 6, nylon 6/6, nylon 11, nylon 6/12, and high-impact nylon. The most preferred thermoplastic base resin is nylon 6 as available from Polymer Composites, Inc. of Winona, Minn., as catalog number RTP 0299-A-X-58759 Natural. The preferred amount of the conductive modifier present in these base resins is about 10 percent by weight.

The composites suitable for use by the present invention exhibit certain mechanical properties for constructing an arc device capable of being mounted within and withstanding the environment of an electrical distribution device like a circuit breaker. The composites exhibit structural integrity, good impact resistance and dimensional stability. Furthermore, the composites exhibit a sufficient heat distortion temperature and achieve a UL temperature index of 100 C. degrees or greater, as measured by UL Subject 756B. Preferably, the composite is flame retardant.

The surface area of arc devices made of the inventive composites appears to melt when attacked by the arc created by the interruption of the electrical contacts. The surface area of the arc device substantially encloses the minute ablative particles which were disintegrated from the contacts. The liquefying of the arc device surface appears to envelope the ablative particles, cool them, and the surface of the arc device rehardens. Accordingly, the ablative particles are actually absorbed by the arc device surface.

The inventive compositions also preferably emit hydrogen gas upon attack by an electric arc. The hydrogen gas emission further cools and extinguished the arc by a process known as outgassing.

The present invention provides a method of removing electric potential from an arc extinguishing device utilized in an electrical distribution device. The method includes the step of molding the arc device using an inventive composition described above.

Preferably, the arc device is molded by conventional techniques such as injection molding. It is desirable for the composite to exhibit high flow properties for molding thin walled arc devices.

While particular embodiments and applications of the present invention have been illustrated and described, it is to be understood that the invention is not limited to the precise construction and compositions disclosed herein and that various modifications, changes, and variations which will be apparent to those skilled in the art may be made in the arrangement, operation, and details of construction of the invention disclosed herein without departing from the spirit and scope of the invention as defined in the appended claims.

What is claimed is:

1. An arc extinguishing device for deposition along a pre-determined path of movement between two electrical contacts in an electrical distribution device, the device comprising:

a generally u-shaped member having a bight portion defined by a bottom wall with two upstanding side walls, the bight portion having sufficient width to allow the movement of the electrical contacts between the two side walls;

the u-shaped member made of a conductive plastic composition, the composition having a thermoplastic base resin and an effective amount of a conductive modifier to exhibit static dissipative properties and remove electric potential from the u-shaped member.

2. The device of claim 1 wherein the thermoplastic base resin is selected from the group consisting of nylon 6/6, nylon 6, nylon 11, nylon 6/12, and high-impact nylon.

3. The device of claim 1 wherein the conductive modifier is a powder selected from a group consisting of amorphous carbon black and stainless steel.

4. The device of claim 1 wherein the conductive modifier is a fiber selected from the group consisting of stainless steel, graphite, and nickel coated graphite.

5. The device of claim 1 wherein the device exhibits a surface resistivity less than $10^9$ ohms per square.

6. The device of claim 1 wherein the conductive modifier is present in the amount of about 4 to about 20 percent by weight.

7. The device of claim 1 wherein the conductive modifier is stainless steel fiber present in the amount of about 10 percent by weight and the thermoplastic resin is nylon 6.

8. The device of claim 1 wherein the conductive modifier is selected from the group consisting of stainless steel fiber and nickel coated graphite fiber, and is present in the amount of about 5 to about 10 percent by weight.

9. The device of claim 1 wherein the conductive modifier is graphite fiber present in the amount of about 10 to about 15 percent by weight.

10. The device of claim 1 wherein the conductive modifier is amorphous carbon black powder present in the amount of about 15 to about 20 percent by weight.

11. The device of claim 1 wherein the conductive modifier is present in an amount effective to also exhibit magnetic properties.

12. The device of claim 11 wherein the conductive modifier is stainless steel fiber present in the amount of about 60 to about 80 percent by weight.

13. An electrical distribution device comprising:

a housing;

a pair of electrical contacts positioned within the housing, at least one contact being movable in and out of engagement with the other along a predetermined path;

an arc extinguishing device disposed along the predetermined path of movement, the device having a generally u-shaped member having a bight portion defined by a bottom wall with two upstanding side walls, the bight portion having sufficient width to allow the movement of the electrical contacts between the two side walls;

the u-shaped member made of a conductive plastic composition, the composition having a thermoplastic base resin and an effective amount of a conductive modifier to exhibit static dissipative properties and remove electric potential from the u-shaped member.

14. The device of claim 13 wherein the device further includes a plurality of arc extinguishing devices arranged in series with end to end.

15. The device of claim 14 wherein the plurality of arc extinguishing devices are positioned with a small gap between the ends thereof.

16. The device of claim 13 wherein the housing further includes means for grounding the device.

17. The device of claim 13 wherein the thermoplastic base resin is selected from the group consisting of nylon 6/6, nylon 6, nylon 11, nylon 6/12, and high-impact nylon.

18. The device of claim 13 wherein the conductive modifier is a powder selected from a group consisting of amorphous carbon black and stainless steel.

19. The device of claim 13 wherein the conductive modifier is a fiber selected from the group consisting of stainless steel, graphite, and nickel coated graphite.

20. The device of claim 13 wherein the device exhibits a surface resistivity less than $10^9$ ohms per square.

21. The device of claim 13 wherein the conductive modifier is present in the amount of about 4 to about 20 percent by weight.

22. The device of claim 13 wherein the conductive modifier is stainless steel fiber present in the amount of about 15 percent by weight and the thermoplastic resin is nylon 6.

23. The device of claim 13 wherein the conductive modifier is selected from the group consisting of stainless steel fiber and nickel coated graphite fiber, and is present in the amount of about 5 to about 10 percent by weight.

24. The device of claim 13 wherein the conductive modifier is graphite fiber present in the amount of about 10 to about 15 percent by weight.

25. The device of claim 13 wherein the conductive modifier is amorphous carbon black powder present in the amount of about 15 to about 20 percent by weight.

26. The device of claim 13 wherein the conductive modifier is present in an amount effective to also exhibit magnetic properties.

27. The device of claim 26 wherein the conductive modifier is stainless steel fiber present in the amount of about 60 to about 80 percent by weight.

28. A static dissipative composition for removing electric potential from an arc extinguishing device in an electrical distribution device, the composition comprising:

a thermoplastic base resin; and an effective amount of a conductive modifier to exhibit static dissipative properties and remove electric potential from the arc extinguishing device of an electrical distribution device.

29. The composition of claim 28 wherein the thermoplastic base resin is selected from the group consisting of nylon 6, nylon 6/6, nylon 11, nylon 6/12, and high-impact nylon.

30. The composition of claim 28 wherein the conductive modifier is a powder selected from a group consisting of amorphous carbon black and stainless steel.

31. The composition of claim 28 wherein the conductive modifier is a fiber selected from the group consisting of stainless steel, graphite, and nickel coated graphite.

32. The composition of claim 28 wherein the composition exhibits a surface resistivity less than $10^9$ ohms per square.

33. The composition of claim 28 wherein the conductive modifier is present in the amount of about 4 to about 20 percent by weight.

34. The composition of claim 28 wherein the conductive modifier is present in an amount effective to also exhibit magnetic properties.

35. The composition of claim 34 wherein the conductive modifier is stainless steel fiber present in the amount of about 60 to about 80 percent by weight.

36. A method of removing electric potential from an arc extinguishing device utilized in an electrical distribution device, the method comprising:

molding an arc extinguishing device from a conductive plastic composition, the composition having a thermoplastic base resin and an effective amount of a conductive modifier to exhibit static dissipative properties.

37. The method of claim 36 wherein the thermoplastic base resin is selected from the group consisting of nylon 6, nylon 6/6, nylon 11, nylon 6/12, nylon 6/12, and high-impact nylon.

38. The method of claim 36 wherein the conductive modifier is a power selected from a group consisting of amorphous carbon black and stainless steel.

39. The method of claim 36 wherein the conductive modifier is a fiber selected from the group consisting of stainless steel, graphite, and nickel coated graphite.

40. The method of claim 36 wherein the composition exhibits a surface resistivity less than $10^9$ ohms per square.

41. The method of claim 36 wherein the conductive modifier is present in the amount effective to also exhibit magnetic properties.

* * * * *